United States Patent [19]

Wolfrey et al.

[11] 4,125,082

[45] Nov. 14, 1978

[54] COLLAPSIBLE ANCHOR RESPONSIVE TO THE RATE OF RELEASE OF ANCHOR LINE TENSION

[76] Inventors: Leslie L. Wolfrey, Box 30, Richardsville, Va. 22736; Charles H. Brown, Box 22A, Lignum, Va. 22726

[21] Appl. No.: 824,134

[22] Filed: Aug. 12, 1977

[51] Int. Cl.[2] ..... B63B 21/30

[52] U.S. Cl. ..... 114/298

[58] Field of Search ..... 114/297, 298, 299, 303, 114/310

[56] References Cited

U.S. PATENT DOCUMENTS

| | | | |
|---|---|---|---|
| 164,975 | 6/1875 | Currier | 114/307 |
| 2,910,955 | 11/1959 | Long | 114/298 |
| 3,082,729 | 3/1963 | Chard | 114/298 |
| 3,747,553 | 7/1973 | Riddle, Sr. | 114/298 |
| 4,038,934 | 8/1977 | Thomson | 114/298 |

*Primary Examiner*—Trygve M. Blix
*Assistant Examiner*—Jesus D. Sotelo
*Attorney, Agent, or Firm*—Griffin, Branigan and Butler

[57] ABSTRACT

An anchor with collapsible flukes is provided with a spring tensioned latching mechanism which normally prevents the flukes from moving from a latched position to a collapsed position. The latching mechanism is unlatched and the flukes collapsed by a releasing mechanism including a compression spring and a firing pin. Tension on an anchor line draws the firing pin against the compression spring and, upon a sudden release of the tension in the anchor line, the firing pin is driven against the latching mechanism to unlatch it and permit collapse of the flukes.

8 Claims, 8 Drawing Figures

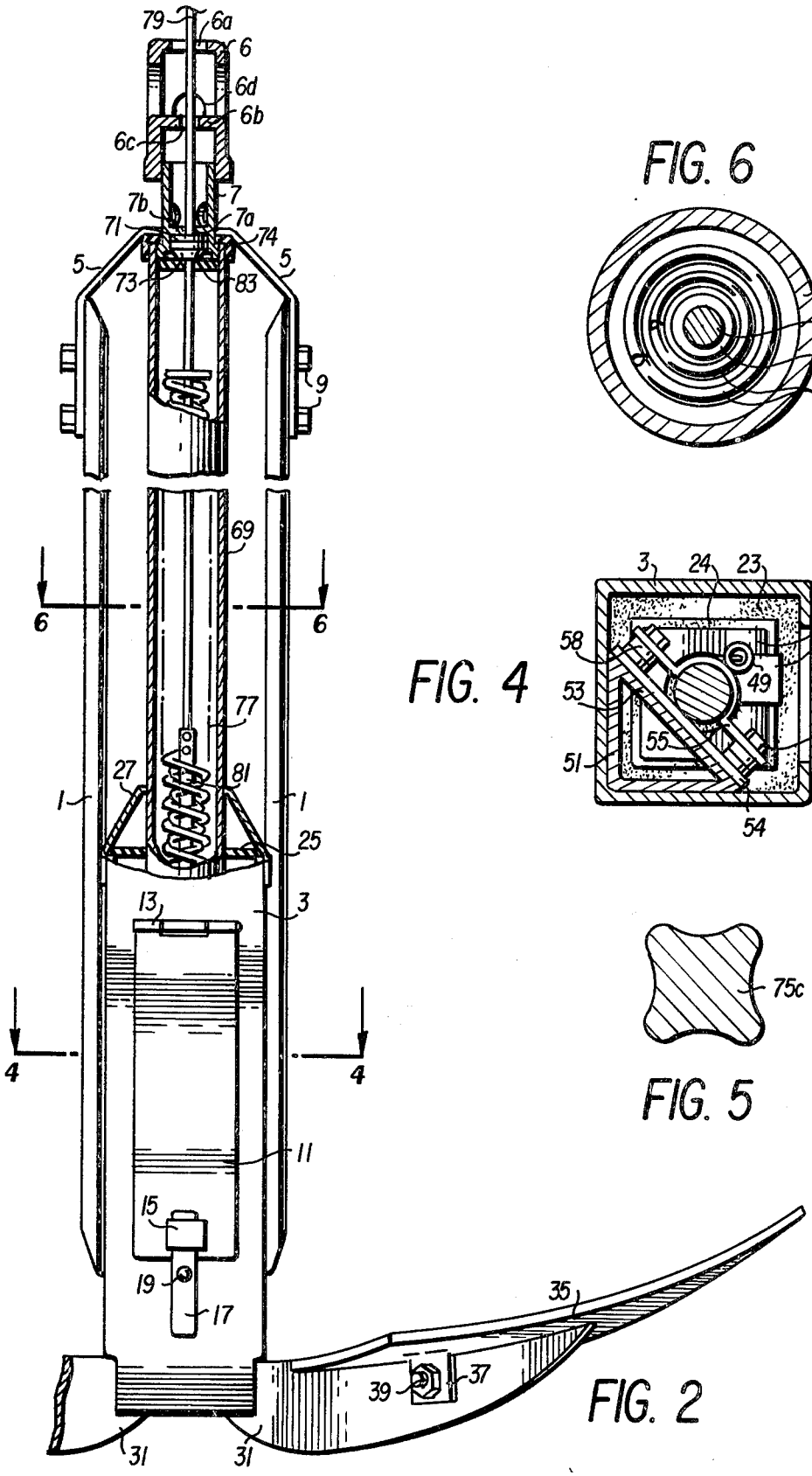
FIG. 2
FIG. 6
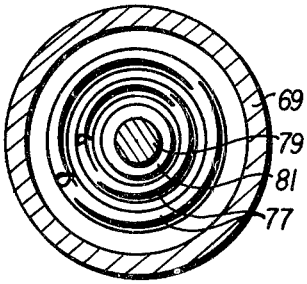
FIG. 4
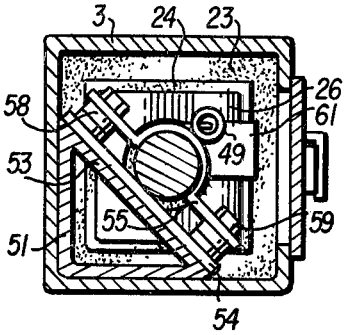
FIG. 5

COLLAPSIBLE ANCHOR RESPONSIVE TO THE RATE OF RELEASE OF ANCHOR LINE TENSION

BACKGROUND OF THE INVENTION

The present invention relates to anchors such as those found on small boats and yachts. More particularly, the present invention relates to a collapsible anchor having a plurality of flukes which are normally radially extended from the lower portion of an anchor shank but may be collapsed so as to extend axially from the anchor shank.

Collapsible anchors having a plurality of normally radially extending flukes are well-known in the art. Such anchors have the advantage that the flukes readily engage the bottom surface of a body of water or engage objects such as rocks, logs, and the like on the bottom to retain the anchor and thereby hold a boat to which the anchor is connected by an anchor line. However, the extended flukes create some difficulties for the boatman in that the flukes frequently engage some object on the water's bottom in such a manner that the anchor cannot be raised when the boatman is ready to do so. To overcome this difficulty, the prior art teaches various mechanisms for collapsing the flukes so that the anchor may be more readily dislodged from an entrapped position.

Generally speaking, the prior art has taken two approaches. In the first approach, as exemplified by U.S. Pat. Nos. 3,747,553 and 4,005,671, a release means is provided which automatically releases the flukes upon application of a predetermined tension to the anchor line. This approach has a disadvantage in that the tension in the anchor line may be sufficient to release the flukes even though the anchor is not entrapped. In the second approach, as exemplified by U.S. Pat. Nos. 3,082,729 and 3,283,736, a line separate from the anchor line is provided. When it is determined that the anchor is entrapped, the boatman pulls this second line to operate the release mechanism which collapses the flukes. This approach has a disadvantage of requiring a separate line which frequently becomes entangled with or wrapped around the anchor line as the anchor rotates in its descent to the bottom.

BRIEF DESCRIPTION OF THE INVENTION

An object of the present invention is to provide a collapsible anchor which will not release in response to excessive tension in the anchor line and which does not require a separate line from the boat to the anchor for the purpose of operating the release mechanism.

An object of the present invention is to provide a collapsible anchor having a shank portion, a plurality of flukes pivotally connected to the shank portion for movement between a latched position and a collapsed position, latch means for preventing movement of the flukes from the latched position to the collapsed position, an anchor line to which tension may be applied, and a release means responsive to the rate of release of the tension applied to the anchor line for releasing the latch means.

A further object of the invention is to provide a collapsible anchor as described above wherein the latch means comprises a latch drive shaft, means supporting the drive shaft for movement along its own axis, first and second latches, means pivotally mounting the latches on the drive shaft, latch spring means for biasing the latches toward first positions, spring means attached to the drive shaft for moving it in a first direction, a fixed body acting against the latches for limiting movement of the drive shaft in the first direction when the latches are in the first position, and blocking means attached to the drive shaft and extending into the path of the flukes for preventing pivoting of the flukes from the latched position while the latches are in the first position.

An object of the invention is to provide an anchor as described above wherein the release means comprises a firing pin attached to the anchor line and a compression spring means surrounding the anchor line and compressed by the firing pin when tension is applied to the anchor line, the firing pin being driven against the latches to move them toward second positions against the bias of the latch spring means upon a sudden decrease in the tension applied to the anchor line whereby the spring means attached to the drive shaft may move the drive shaft in the first direction thereby removing the blocking means from the path of the flukes.

A further object of the invention is to provide an anchor as described above wherein the release means and all of the elements of the latch means except the blocking means are enclosed within an enclosure which prevents the entry of sand and other foreign matter therein.

Other objects of the invention and its mode of operation will become apparent upon consideration of the following description and the accompanying drawings.

BRIEF DESCRIPTION OF THE DRAWINGS

FIG. 2 is a front view, partly in section, of a collapsible anchor with the flukes extended for use;

FIG. 4 is a sectional view taken along the line 4—4 of FIG. 2;

FIG. 5 is a sectional view of a firing pin as taken along the line 5—5 of FIG. 3*c*; and, FIG. 6 is a sectional view taken generally along the line 6—6 of FIG. 2.

DETAILED DESCRIPTION OF THE INVENTION

Figure 1:
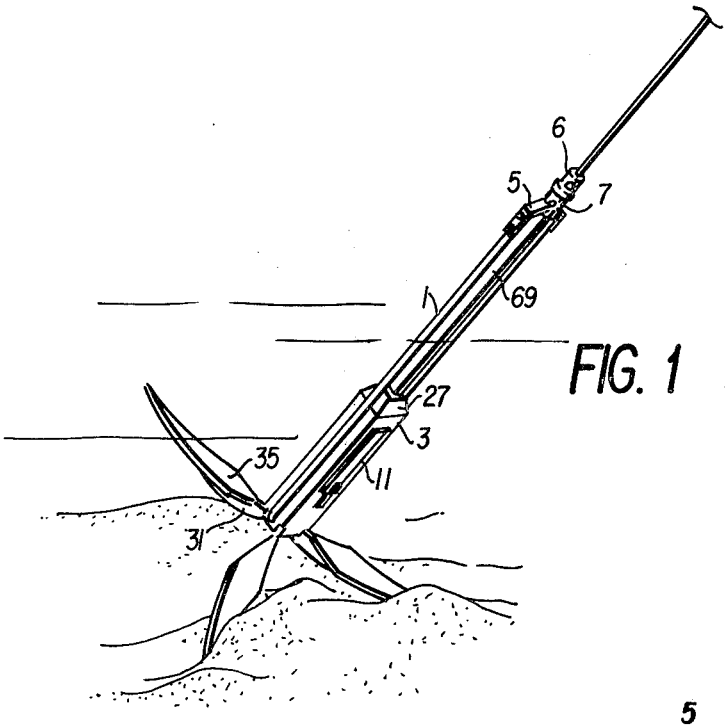
FIG. 1 is a pictorial view of a collapsible anchor as it might appear resting on the bottom of a body of water.

As illustrated in FIGS. 1 and 2, a preferred embodiment of the invention includes a shank portion comprising two elongated metal member 1, a hollow elongated housing 3 of square cross section, a pair of metallic bracket members 5, a guide cap 6 and a hollow pipe-like member 7. Members 1 are attached to two sides of housing 3 by welding or other suitable means. Brackets 5 are welded to member 7 and are attached to the upper portions of members 1 by screws or bolts 9.

Guide cap 6 has a circular opening 6*a* in its top surface and is completely open at the bottom. The guide cap 6 has a barrier element 6*b* located intermediate its ends and the barrier element 6*b* has a central opening 6*c* therein which is somewhat smaller than the opening 6*a*. Guide cap 6 is provided with a plurality of openings 6*d* around its periphery at a level just above barrier 6*b* to permit egress of sand from the cap which might enter therein through opening 6*a*. The opening 6*a* together with the smaller opening 6*c* tend to align an anchor line 79 so that the anchor line passes generally axially into the pipe-like member 7, and, more particularly, through a hole 7*a* which is smaller than hole 6*c* and only slightly larger than the diameter of the anchor line. Member 7 and guide cap 6 are threaded so that the cap may be screwed onto the top end of member 7.

Housing 3 has a door 11 attached to the housing by a hinge 13. A catch 15 is attached to the door and cooperates with a latch 17 mounted on a pivot 19 for locking the door tightly against the face of housing 3. Door 11 closes an opening in the side of housing 3 but permits access to a sealed compartment 21 formed within the housing 3. A sliding rubber seal 23 forms the bottom closure of compartment 21. Seal 23 has a large center opening therein through which a shaft 43 extends. Another flexible seal 24 is located above seal 23 and surrounds shaft 43 to close the opening in seal 23. A fixed plate 26 limits the upward flexing of seal 24 as shaft 43 is moved upwardly. Plate 26 is attached to the lower portion of an angle member 51 (FIG. 4) and a flat plate 53.

A rubber seal 25 (FIG. 2) forms the top closure of compartment 21. Seal 25 is held in place by a housing cap 27 (FIGS. 1 and 2) which fits tightly over the housing 3.

Four elongated recesses 29 extend upwardly from the bottom of housing 3 at each corner of the housing. Each of these recesses receives and guides a rock point or fluke 31. Each rock point 31 is mounted for free rotation on a pivot pin 33 and each of these pivot pins is welded at each end to an interior wall of the housing 3. As illustrated in FIG. 2, each rock point 31 has a hole therein by means of which a sandpoint 35 may be attached thereto. Each sandpoint 35 has a downwardly depending bracket 37 welded thereto. The bracket has a hole therein which aligns with the hole in the rock point and a rock point and a sand point are held together by a bolt and nut connection 39. Thus, with the sand points 35 removed the anchor may be used in bodies of water having rocky bottoms but when the anchor is used in a body of water having a sandy bottom, the sandpoints 35 may be attached thereto.

A latching means is provided for normally latching the rock points 31 in the outwardly extending position illustrated in FIGS. 1, 2, 3*a*, and 3*b*. The latching means comprises a pair of latch arms or latches 41 (FIGS. 3*a*–3*c*), a latch drive shaft 43, a lock block 45, a latch spring 47 and a latch shaft spring 49.

Latch shaft 43 is supported in the center of the housing 3 by a support means comprising L-shaped member 51, the mounting plate 53, an upper U-shaped retainer 55 (FIG. 3*a*) and a lower U-shaped retainer 57. The member 51 is attached to two interior walls of the housing 3 by suitable fasteners such as screws (not shown) so as to be easily removed from housing 3. Mounting plate 53 is welded or otherwise attached to the member 51 and the upper and lower retainers 55 and 57 are attached to the mounting plate 53 by screws 59.

Figure 3A:
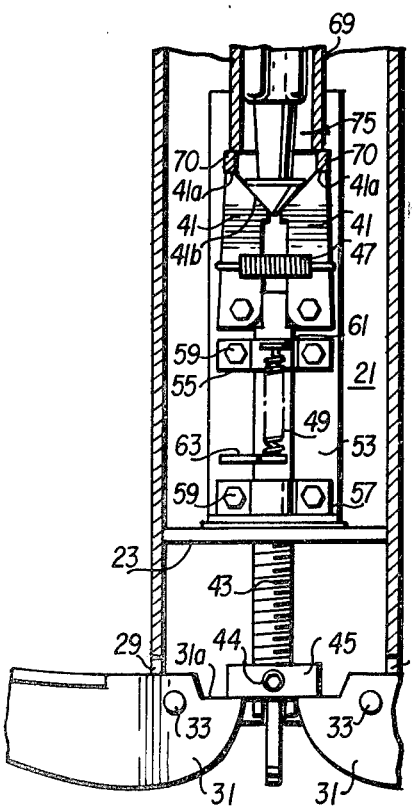
FIGS. 3*a*–3*c* are sectional views illustrating the operation of the latching and release mechanisms.
Figure 3B:
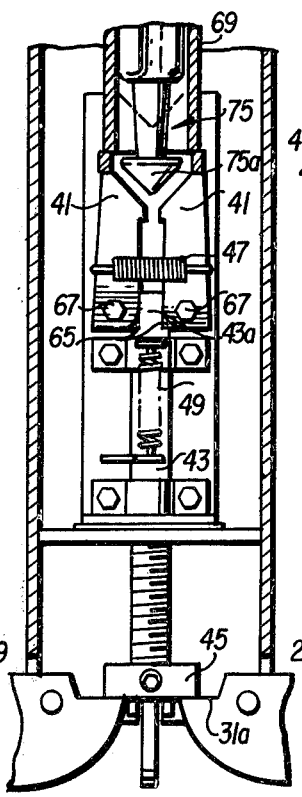
Figure 3C:
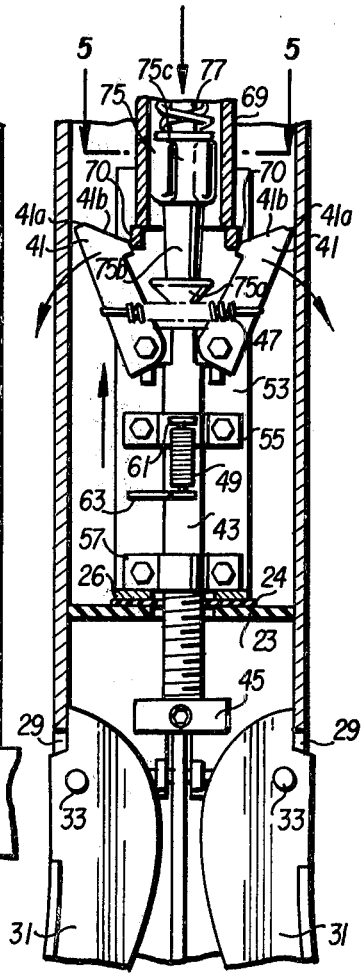

Retainers 55 and 57 do not clamp latch shaft 43 tightly against mounting plate 53. Instead, the retainers hold the shaft slidingly against two bearing plates which are attached to the mounting plate so that the shaft may freely move vertically. One of these plates 54 is shown in FIG. 4. Spacers 58 may be included, as necessary, depending upon the shape of retainers 55 and 57. Upper retainer 55 is provided with a horizontally extending tab 61 and a second tab 63 is attached to the shaft 43. The latch shaft spring 49 is attached between the two tabs and normally tends to move the shaft 43 upwardly toward a position as illustrated in FIG. 3*c*. However, latches 41 normally prevent such movement. Two diametrically opposed support arms 65 (FIG. 3*b*) are attached to the shaft 43 and a latch 41 is pivotally attached to each arm by a pivot screw means 67. The latch spring 47 tends to draw the latches 41 toward each other but movement of the latches toward each other is limited because the latches strike the upper portion 43*a* of shaft 43 which is flattened on opposing sides as viewed in FIG. 3. Therefore, the latches 41 normally tend to assume the position illustrated in FIGS. 3*a* and 3*b*. In this position, the tips or upper surfaces 41*a* of the latches engage two stops 70. These stops are attached to the face of mounting plate 53 and tacked or welded to the lower edge of a hollow cylindrical guide member 69. Thus, upward movement of the shaft 43 and the latches 41 in response to the force applied by spring 49 is limited by engagement of the latches 41 with the stops 70.

As illustrated in FIG. 2, the guide member 69 fits over or around the outwardly flared lower end of the top member 7. The upper end of guide member 69 is sealed by a seal 71 which is held in place by a retainer 73 and by an abutment 7*b* within member 7. This arrangement prevents entry of sand into guide member 69 through a hole 7*a*, the hole being provided for passage of the anchor line 79 into the guide member. An annular rubber seal 74 seals the joint between the guide member 69 and member 7. In assembling the anchor, the seal 71 and retainer 73 are placed on the upper portion of guide member 69 before the top member 7 is lowered thereon through seal 74. After the top member is brought into position, it is affixed to the members 1 by screws 9.

The guide member 69 serves as a guide for a release mechanism which includes a firing pin 75 (FIG. 3*c*) and a firing spring means 77, both of which are smaller in diameter than the internal diameter of the guide member 69.

The firing pin has a cone-shaped head 75*a* connected by a shank portion 75*b* to a fluted body portion 75*c*. As best illustrated in FIG. 3*a*, the surfaces of head 75*a* are at the same angle with respect to each other as the surfaces 41*b* of the latches. The body portion 75*c* has a cross-section as illustrated in FIG. 5 to permit free escape of water from one side of the firing pin to the other.

The anchor line 79 which may, for example, be a wire rope, is connected to a rod 81 which is attached in turn to the body 75*c* of the firing pin. As illustrated in FIG. 2, spring means 77 comprises two oppositely wound compression springs. Preferably, each compression spring actually comprises two or more longitudinally arranged springs. These springs surround anchor line 79 and rod 81 within the guide member 69 and rest freely on the body 75*c* of the firing pin. A guide ring 83 surrounds anchor line 79 above spring means 77. The guide ring is preferably made from a hard rubber or plastic material.

It should be noted that FIG. 2 illustrates the state of the spring means 77 when the firing pin 75 and latches 41 are in the position shown in FIG. 3*a*. The spring means rests on the top of the body 75*c* and there is little, if any, compression of spring means 77.

Assuming that the anchor is in the released position shown in FIG. 3*c*, it may be set for use by the following procedure. First, the anchor is inverted so that the flukes fall into a spread position. Door 11 is opened to give access to the operating mechanism within housing 3. After the points 31 have been spread, anchor line 79 is drawn downwardly thereby insuring that firing pin 75 rests on spring means 77 and thus is out of the path of latches 41. The anchor line need not be held but may then be released. The user then pushes upwardly on tab 63 thus moving latch shaft 43 upwardly (i.e., downwardly as viewed in FIG. 3 since the anchor is inverted). As the shaft 43 is moved upwardly, the angled surfaces 41*b* of latches 41 slide along the bottoms of stops 70 as the latch spring 47 tends to draw the latches together. Tab 63 is pushed upwardly far enough to allow latches 41 to completely clear the stops 70 thus allowing spring 47 to draw the latches into the vertical position. Manual pressure is then removed from tab 63 and the spring 49 draws drive shaft 43 and latches 41 downwardly until the surfaces 41*a* of the latches engage the stops 70. At this time, the anchor is in the latched position and ready for use. It should be noted that as the shaft 43 is pressed upwardly, the lock block 45 engages the surfaces 31*a* of points 31 and, as illustrated in FIG. 3*a*, when the anchor is in the latched position, the lock block 45 engages surfaces 31*a* to prevent pivoting of the points 31 back to their released position. Lock block 45 is threaded internally so that it may be screwed onto shaft 43 and locked in position by a set screw 44. This permits adjustment of the lock block and thus the position at which the flukes will be latched.

The anchor is ready for use once it has been latched. It may be lowered into the water where the sand points 35 dig into the sand on the bottom of the body of water. If the bottom of the body of water is rocky rather than sandy, the sandpoints 35 will not be used but instead will be removed and only the rock points 31 utilized. As winds and current tend to cause the boat to drift, the anchor line 79 is drawn taut as the points of the anchor grasp or dig into the surface on the bottom of the body of water. The tension applied to the anchor line draws the firing pin 75 upwardly into the guide member 69 as illustrated in phantom outline in FIG. 3*b*. The anchor line tension draws the firing pin 75 upwardly, thus compressing the spring means 77 whose upward movement is limited by the seal 71. Furthermore, wave action causing the boat to rise and fall causes a varying amount of compression of the spring means. As the boat rides upwardly on a wave, the tension in anchor line 79 is increased as is the compression of spring means 77. As the boat drifts downwardly into the trough following a wave, the anchor line 79 becomes slack thereby permitting spring means 77 to partially or even fully expand to its natural uncompressed state. Thus, the firing pin 75 may alternately be drawn upwardly to or above the position shown in FIG. 3*b* and then released to fall downwardly to the position shown in FIG. 3*a*. The wave action causes the boat to rise and fall at a relatively slow rate. Thus, the tension in anchor line 79 is increased or decreased at a relatively slow rate thus causing a slow rate of increase or decrease in the compression of spring means 77. Therefore, in response to the wave action, the firing pin 75 may engage the latches 41 but its rate of movement at the time of engagement is quite slow. Therefore, the wave action will not cause the anchor to release thereby collapsing the points 31.

It is a frequent occurrence for the points of an anchor to become so engaged with rocks or debris that it is impossible to raise the anchor even when it is desired to do so. The probability of freeing the anchor under such circumstances is greatly enhanced if the points 31 can be released so that they are more axially aligned with the body of the anchor as illustrated in FIG. 3*c*. In the present invention, the points 31 are collapsed merely by grasping the anchor line 79, pulling it taut to compress the spring means 77, and then suddenly releasing the anchor line. When the anchor line is suddenly released, the compressed spring means 77 drives the firing pin 75 downwardly at a high rate of speed. The head 75*a* of the firing pin strikes the surfaces 41*b* of the latches thus driving them apart against the tension of spring 47. As the latches are driven apart, their surfaces 41*a* move outwardly beyond the stops 70. When this occurs, the tension in spring 49 pulls shaft 43 upwardly so that the latches 41 are held apart by the stops as illustrated in FIG. 3*c*. As the shaft 43 moves upwardly, it carries lock block 45 out of the patch of the points 31 thus leaving the points 31 free to rotate about the pins 33. The points 31 are thus free to assume the position illustrated in FIG. 3*c* where they are axially aligned with the shank of the anchor. Thus, the anchor is more readily freed from the obstruction which holds it. After the anchor is freed, it may be drawn into the boat and then relatched as described above to make it ready for reuse.

It should be noted that the tension applied to anchor line 79 during the release procedure is not the major factor in accomplishing the release. Instead, it is the rate at which the tension in the anchor line is relaxed that accomplishes the release. While it is true that the tension applied to anchor line 79 during the release procedure must be sufficient to compress spring means 77, this tension does not necessarily have to be as great as the tension that might occur in the anchor line as a result of wave action. However, the wave action causes a relatively slow dissipation of the energy stored in spring means 77 so that the firing pin 75 is not projected downwardly at a high rate of speed whereas during the release procedure the energy stored in spring means 77 is suddenly applied to the firing pin 75 to drive it downwardly at a high rate of speed.

In summary, it is seen that the present invention provides a collapsible anchor which requires no release line in addition to the anchor line, requires no maneuvering of the boat relative to the anchor in order to release the anchor points, and does not release the anchor points automatically upon the attainment of a predetermined anchor line tension.

While a preferred embodiment of the invention has been described in specific detail, it will be understood by those skilled in the art and others that various modifications and substitutions may be made in the embodiment shown without departing from the spirit and scope of the invention as defined by the appended claims.

We claim:

1. A collapsible anchor comprising:

an elongated shank portion;

a plurality of flukes;

means pivotally connecting said flukes to said shank portion for pivotal movement between a latched position whereat said flukes extend radially outwardly from said shank portion, and a collapsed position whereat said flukes extend generally parallel to the length of said shank portion;

latch means mounted on said shank portion for preventing movement of said flukes from said latched position to said collapsed position;

an anchor line to which tension may be applied; and, release means responsive to the rate of change of the tension applied to said anchor line for releasing said latch means whereby said flukes may pivot to said collapsed position;

said latch means comprising:

a latch drive shaft;
means supporting said drive shaft for movement in the axial direction of said drive shaft;
a latch;
means for mounting said latch for pivoting movement on said drive shaft;
a latch spring for biasing said latch toward a first position;
spring means attached to said drive shaft for moving it in a first direction;
further means acting against said latch for limiting movement of said drive shaft in said first direction when said latch is in said first position; and,
blocking means attached to said drive shaft and extending into the path of said flukes for preventing pivoting of said flukes from said latched position while said latch is in said first position.

2. An anchor as claimed in claim 1 wherein said release means comprises:
a firing pin attached to said anchor line; and,
a compression spring compressible by said firing pin when tension is applied to said anchor line;
said firing pin being driven against said latch to move it toward a second position against the bias of said latch spring when tension is suddenly decreased in said anchor line whereby the spring means attached to the drive shaft may move said drive shaft in said first direction thereby removing said blocking means from the path of said flukes.

3. A collapsible anchor comprising:
a shank portion;
a plurality of flukes;
means for pivotally connecting said flukes for pivotal movement between a latched position and a collapsed position;
latch means for preventing movement of said flukes from said latched position to said collapsed position;
an anchor line to which tension may be applied; and,
release means responsive to the rate of release of the tension applied to said anchor line for releasing said latch means whereby said flukes may pivot to said collapsed position;
said latch means comprising:
a latch drive shaft;
means supporting said drive shaft for movement along its own axis;
first and second latches;
means pivotally mounting said latches on said drive shaft;
latch spring means for biasing said latches toward first positions;
spring means attached to said drive shaft for moving it in a first direction;
a fixed body acting against said latches for limiting movement of said drive shaft in said first direction when said latches are in said first position; and, direction when said latches are in said first position; and,
blocking means attached to said drive shaft and extending into the path of said flukes for preventing pivoting of said flukes from said latched position while said latches are in said first positions.

4. An anchor as claimed in claim 3 wherein said release means comprises:
a firing pin attached to said anchor line; and,
a compression spring means surrounding said anchor line and compressible by said firing pin when tension is applied to said anchor line;
said firing pin being driven against said latches to move them toward second positions against the bias of said latch spring means upon a sudden decrease in the tension applied to said anchor line whereby the spring means attached to the drive shaft may move said drive shaft in said first direction thereby removing said blocking means from the path of said flukes.

5. An anchor as claimed in claim 4 wherein said latch spring means comprises a tension spring connected between said two latches and biasing them toward each other.

6. An anchor as claimed in claim 4 and further comprising a cylindrical member surrounding said firing pin and said compression spring means; and a closure means at one end of said cylindrical member having an opening through which said anchor line extends, said compression spring means being positioned between said firing pin and closure means, and said compression spring means being uncompressed and spaced from said closure means when no tension is applied to said anchor line.

7. An anchor as claimed in claim 4 wherein:
said fixed body comprises a hollow cylindrical member which surrounds and defines the path of movement of said compression spring means and said firing pin.

8. An anchor as claimed in claim 7 and further comprising:
seal means for sealing one end of said cylindrical member, said seal means having an opening therein through which said anchor line extends;
said shank portion including a sealed enclosure into which said cylindrical member extends;
said first and second latches being located within said enclosure and said drive shaft extending from within the enclosure to the exterior thereof through a wall of said enclosure.

* * * * *